United States Patent [19]

Hamner et al.

[11] 4,120,709

[45] Oct. 17, 1978

[54] TECHNIQUE FOR IMPROVING PROCESSIBILITY OF CERTAIN COMPOSITE PROPELLANTS BY CALCINING THE IRON OXIDE BURNING RATE CATALYST

[75] Inventors: James W. Hamner; James O. Hightower, both of Huntsville; Carl M. Rector, New Market, all of Ala.

[73] Assignee: Thiokol Corporation, Newtown, Pa.

[21] Appl. No.: 354,293

[22] Filed: Apr. 25, 1973

[51] Int. Cl.[2] ..... C06B 45/10

[52] U.S. Cl. ..... 149/19.92; 149/19.4; 149/20

[58] Field of Search ..... 149/19.4–19.6, 149/19.9, 19.92, 20, 44, 76, 86

[56] References Cited

U.S. PATENT DOCUMENTS

| | | | |
|---|---|---|---|
| 3,532,567 | 10/1970 | Winkler et al. | 149/19.4 |
| 3,698,967 | 10/1972 | Thompson et al. | 149/19.92 X |
| 3,734,786 | 5/1973 | Walden et al. | 149/19.92 |
| 3,748,199 | 7/1973 | Vriesen et al. | 149/19.4 |
| 3,790,416 | 2/1974 | Dehm | 149/19.9 X |

*Primary Examiner*—Edward A. Miller

*Attorney, Agent, or Firm*—Stanley A. Marcus; William R. Wright, Jr.

[57] ABSTRACT

A technique for improving the processibility of composite propellants through reduction of the catalytic effect of iron oxide upon the polymer/curing agent reaction.

3 Claims, No Drawings

TECHNIQUE FOR IMPROVING PROCESSIBILITY OF CERTAIN COMPOSITE PROPELLANTS BY CALCINING THE IRON OXIDE BURNING RATE CATALYST

BACKGROUND OF THE INVENTION

1. Field of the Invention

This invention relates to a process for improving the processibility of composite propellants. More particularly, this invention relates to a process for improving pot life of certain composite propellants by eliminating the catalytic effect of iron oxide on the curing agent-/polymer reaction without adversely affecting the propellant burning rate accelerating characteristics of the iron oxide.

2. Description of the Prior Art

Solid composite propellants are composed largely of (1) organic polymer binder fuel; (2) inorganic oxidizers; (3) metallic powders such as aluminum; and (4) a burning rate catalyst, such as iron oxide, where higher mass discharge rates are required. Major polymer binders in common useage today are the polyurethane types which are based on hydroxyl-terminate polymers such as hydroxy-terminated polybutadiene, hydroxyl-terminated polyesters, and hydroxyl-terminated polyethers cured with di-or tri-functional organic isocyanate compounds. Other polymer binders of some significance are those based on carboxyl-terminated polymers such as carboxyl-terminated polybutadiene cured with di- or tri-functional aziridines and/or epoxide compounds. Ammonium perchlorate, ammonium nitrate, RDX, and HMX are commonly used as the oxidizing agents in composite propellants. Metallic powders such as aluminum are often added to these compositions to increase energy level and to obtain a greater propellant weight in a given volume loading. There are different commonly used methods of increasing propellant burning rate: (1) use finer oxidizer particles; (2) use finer metallic particles; (3) operate at higher motor chamber pressures; (4) use a burning rate catalyst.

Iron oxide is a commonly used burning rate catalyst in various composite propellant compositions. However, a significant loss in propellant pot life, resulting in poor processing properties, is regularly encountered when using this material. This loss in pot life is essentially due to the catalytic effect of the iron oxide on the cure rate of the polymer binder. The pot life problem is especially acute in those propellant compositions where the polymer binder is of the polyurethane type. The short pot life of these composite propellants containing iron oxide results in a rapid increase in propellant viscosity during processing which leads to the formation of trapped voids in the cast propellant and the subsequent rejection of large numbers of defective rocket motors or the production of rocket motors of inferior quality. It is therefore necessary in order to overcome this problem to eliminate or at least greatly reduce the catalytic effect of the iron oxide on the cure rate of the polymer binder without adversely affecting the burning rate modifying characteristics of the iron oxide.

It is accordingly a primary object of the present invention to improve the processing characteristics of composite propellants containing iron oxide. It is a further more specific object of the invention to improve the processing characteristics of composite propellants containing iron oxide by reducing or eliminating the catalytic effect of iron oxide on the cure rate of the propellant binder without affecting the burning rate modifying characteristics of the iron oxide.

Other objects and advantages of the present invention will become apparent to those skilled in the art in view of the following detailed description.

SUMMARY OF THE INVENTION

The objects set forth above can in general be accomplished in accordance with the present invention by calcining the iron oxide burning rate catalyst at a temperature of from about 225° C. to about 850° C. prior to admixture of said burning rate catalyst with other ingredients of the composite propellant. It has been found that calcining the iron oxide eliminates or greatly reduces its catalytic effect on the cure rate of the polymer binder employed in the propellant without affecting the burning rate modifying characteristics of the iron oxide.

DESCRIPTION OF THE PREFERRED EMBODIMENTS

The catalytic effect of iron oxide upon the reaction rate of standard propellant polymer binders such as hydroxyl terminated polybutadiene binders with organic isocyanate curing agents can be eliminated or at least greatly reduced by calcining the iron oxide at temperatures of from about 225° C. to about 850° C., preferably at about 500° C. It should be observed that the calcining temperature should not exceed 850° C. in order to avoid adverse effects upon the burning rate characteristics of the iron oxide. In calcining the iron oxide any well known procedure may be used. In this case, excellent results were obtained by merely heating the iron oxide in a common furnace.

The following procedure was employed in determining the effect of calcined iron oxide on the pot life of a composite propellant. A standard propellant formulation containing commercial grade iron oxide such as the formulation shown below was mixed and served as the control (i.e. propellant mix I.) Four additional propellant formulation Mixes II–V) were mixed using the same base formulations except that the commercial grade iron oxide (uncalcined) was replaced with iron oxide calcined at various temperatures (i.e. 105° C. to 850° C.). The pot life of the various propellant formulations was determined by measuring the viscosity of the composition just prior to curing agent addition and at various time intervals thereafter. Formulations and test results are shown below.

| Propellant Base Formulation | Percent by Weight | Range |
|---|---|---|
| Hydroxyl-terminated liquid polybutadiene | 14.0 | 10–20 |
| Ammonium perchlorate | 68.0 | 50–75 |
| Aluminum powder | 16.0 | 5–22 |
| $Fe_2O_3$ | 2.0 | 0.1–3 |

TABLE 1

| Propellant Mix No. | $Fe_2O_3$ Calcining Temperature (° C) | Remarks |
|---|---|---|
| I | Standard (not calcined) | This propellant has a viscosity of 20 kp prior to curing agent addition, but has increased to 32 kp within 20 minutes and continues to become increasingly viscous. |
| II | 105 | No improvement was observed in processig properties of the propellant |

TABLE 1-continued

| Propellant Mix No. | $Fe_2O_3$ Calcining Temperature (° C) | Remarks |
|---|---|---|
| | | containing iron oxide calcined at this temperature. |
| III | 250 | Propellant has a viscosity of 22 kp prior to curing agent addition. Forty-five minutes after curing agent is added, propellant viscosity is only 18 kp and propellant remains processible for approximately five hours. |
| IV | 500 | Propellant viscosity is 22 kp prior to curing agent addition. Forty-five minutes after curing agent is added the propellant viscosity is only 20 kp and remains processible for approximately five hours. |
| V | 850 | Propellant viscosity is 20 kp prior to curing agent addition. Fifteen minutes after curing agent addition, the propellant viscosity is 16 kp. Forty-five minutes after curing agent addition, the viscosity remains at 16 kp. |

A similar propellant composition containing a polymer binder based on hydroxyl-terminated polyester polymer and di or tri-functional organic isocyanate curing agents would show the same improvement in processing characteristics (i.e. pot life) when the iron oxide is calcined at temperatures of from about 225° C. to 850° C. A similar propellant composition containing a polymer binder based on carboxyl-terminated polybutadiene polymer and di- or tri-functional aziridine curing agent was evaluated in the same manner as in propellant mixes I–V. The pot life of those propellant mixes containing iron oxide which had been calcined at temperatures of from 225° C. to 850° C. showed an improvement in pot life compared to the pot life of the control composition containing uncalcined commercial grade iron oxide. However, the magnitude of the improvement was not as great as the propellant compositions having polymer binders based on hydroxyl-terminated polymers and organic isocyanate curatives. The above data clearly shows that the use of calcined iron oxide in composite propellants significantly improves the pot life of the propellant composition.

No special procedures are required for the mixing of the propellant samples other than standard methods or procedures employed in the art. For example, the hydroxyl-terminated polybutadiene, iron oxide burning rate catalyst, and aluminum powder are blended in a mixer after which the inorganic oxidizer (e.g. ammonium perchlorate) is added in increments and thoroughly mixed until uniform. The curing agents, cross-linking agents, or other additives are generally added and thoroughly blended with the mix near the end of the mix cycle. Generally, mixing during the last part of the mixing operation is accomplished under vacuum to eliminate air entrapment or voids in the propellant. The temperature of the mix is generally maintained in the range of about 140° F. to 160° F.

Where the propellant formulations of the present invention are based on carboxyl-terminated polybutadiene polymers, known curing agents such as diaziridines, triaziridines, diepoxides, triepoxides, or mixtures thereof may conveniently be employed. Propellant formulations based on hydroxyl-terminated polymers will suitably employ known di- or tri-functional organic isocyanate curing agents. An amount of curing agent up to about 2% by weight of all the combined propellant ingredients is sufficient for curing. The precise amount of curing agent used is dependent upon the curing time, the curing temperature, and the final physical properties desired for the propellant.

The propellant compositions employed in the present invention may vary in both the quantities and type of ingredients used. In general, these compositions will contain a polymer binder in amounts ranging from about 10% to about 20% by weight of total composition, metal powder (e.g. aluminum) in amounts ranging from about 5% to about 22% by weight of total composition, inorganic oxidizers (e.g. ammonium perchlorate) in amounts of from about 50% to about 75% by weight of total composition, and iron oxide burning rate catalyst in amounts of from about 0.1% to about 3.0% by weight of total composition. These compositions may also contain various special purpose additives well known in the propellant arts such as fillers, plasticizers, high temperature stabilizers and the like. These special purpose additives may be present in amounts ranging from about 0% to about 10% by weight of total composition.

It is to be understood, therefore, that while the present invention has been described by means of the foregoing examples to illustrate the use of this invention, many variations and modifications will occur to those skilled in the art and it is to be understood that such variations and modifications may be adhered to without departing from the original spirit of the invention and the scope of intended claims.

We claim:

1. A method of lengthening the processing pot life of a hydroxy terminated isocyanate cured polymer propellant containing ammonium perchlorate, aluminum powder and iron oxide which comprises the use of iron oxide which has been calcined at a temperature in the range of from 225° C. to 850° C. inclusive prior to admixture into the propellant.

2. The method as recited in claim 1 wherein the iron oxide has been calcined at a temperature of 500° C.

3. The method as recited in claim 1 wherein the hydroxyl-terminated polymer is selected from the group consisting of hydroxyl-terminated polybutadiene, hydroxyl-terminated polyester, and hydroxyl-terminated polyether.

* * * * *